US007735200B2

(12) United States Patent
Pferdmenges et al.

(10) Patent No.: US 7,735,200 B2
(45) Date of Patent: Jun. 15, 2010

(54) APPARATUS AT A SPINNING PREPARATION MACHINE, ESPECIALLY A FLAT CARD, ROLLER CARD, OR THE LIKE, HAVING A ROLLER, E.G. A CYLINDER, WHICH HAS A CYLINDRICAL CLOTHED PERIPHERAL SURFACE

(75) Inventors: Gerd Pferdmenges, Jüchen (DE); Robert Többen, Mönchengladbach (DE); Thomas Schmitz, Mönchengladbach (DE); Armin Leder, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 1022 days.

(21) Appl. No.: 11/476,175

(22) Filed: Jun. 28, 2006

(65) Prior Publication Data

US 2007/0033917 A1 Feb. 15, 2007

(30) Foreign Application Priority Data

Aug. 12, 2005 (DE) ..... 10 2005 038 401

(51) Int. Cl.
*D01G 15/00* (2006.01)

(52) U.S. Cl. ..... 19/98; 19/102

(58) Field of Classification Search ..... 19/98, 19/102

See application file for complete search history.

(56) References Cited

U.S. PATENT DOCUMENTS 5,040,272 A * 8/1991 Fritzsche ..... 19/104
5,625,924 A * 5/1997 Sauter et al. ..... 19/103
5,642,553 A * 7/1997 Leifeld ..... 19/98
5,930,869 A 8/1999 Faas et al.
6,317,931 B1 * 11/2001 Steinert ..... 19/104
6,408,488 B1 * 6/2002 Leder et al. ..... 19/114
7,162,776 B2 * 1/2007 Schmitz ..... 19/102

FOREIGN PATENT DOCUMENTS

DE 29 48 825 C2 12/1980

(Continued)

OTHER PUBLICATIONS

British Search Report for Application No. GB0615758.0, Dec. 8, 2006.

(Continued)

*Primary Examiner*—Shaun R Hurley
(74) *Attorney, Agent, or Firm*—Venable LLP; Robert Kinberg; Leigh D. Thelen

(57) ABSTRACT

In an apparatus at a spinning preparation machine, especially a card, having a clothed roller, at least machine element located opposite the roller clothing and spaced radially therefrom, and having two fixed lateral holding devices on which work elements are mounted, first and second measuring elements, connected to a control device are provided for detecting variables linked to the dimensions of the roller. The first measuring element comprises a temperature probe for the temperature of the roller surface. The second measuring element comprises a rotational speed sensor for the roller speed. To allow an actual carding nip to be determined, permitting a comparison with a preset carding nip, a third measuring element for the temperature of the holding devices is provided and the control device determines the actual spacing for the roller and the side panels.

27 Claims, 7 Drawing Sheets

I-I

FOREIGN PATENT DOCUMENTS

| | | | |
|---|---|---|---|
| DE | 199 07 288 | A1 | 8/2000 |
| DE | 101 06 315 | A1 | 8/2002 |
| EP | 0 627 508 | A1 | 12/1994 |
| EP | 801158 | A1 | 10/1997 |
| EP | 1 215 312 | A1 | 6/2002 |
| FR | 2850981 | A1 | 8/2004 |
| GB | 2037829 | A | 4/1993 |
| GB | 2398083 | A | 8/2004 |
| WO | WO 7900983 | | 11/1979 |

OTHER PUBLICATIONS

French Preliminary Search Report and Written Opinion issued in corresponding French Appln. No. FR 0653363 dated Oct. 17, 2008.

* cited by examiner

I-I

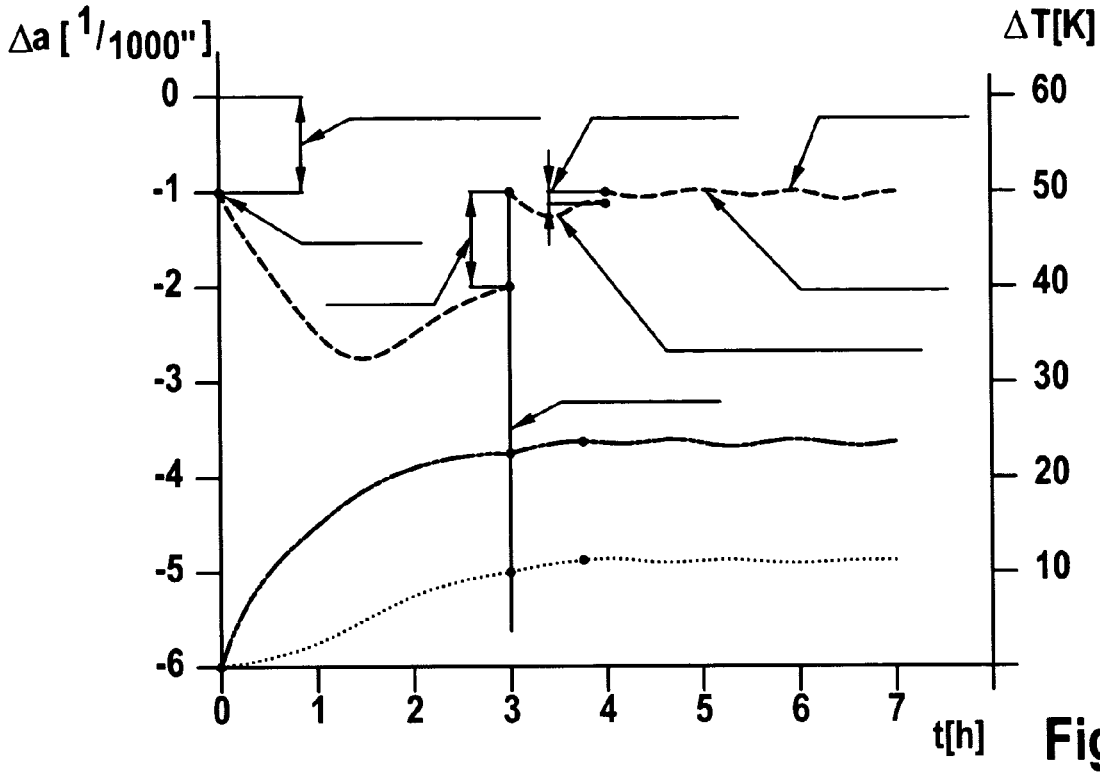
Fig.9
Fig.10
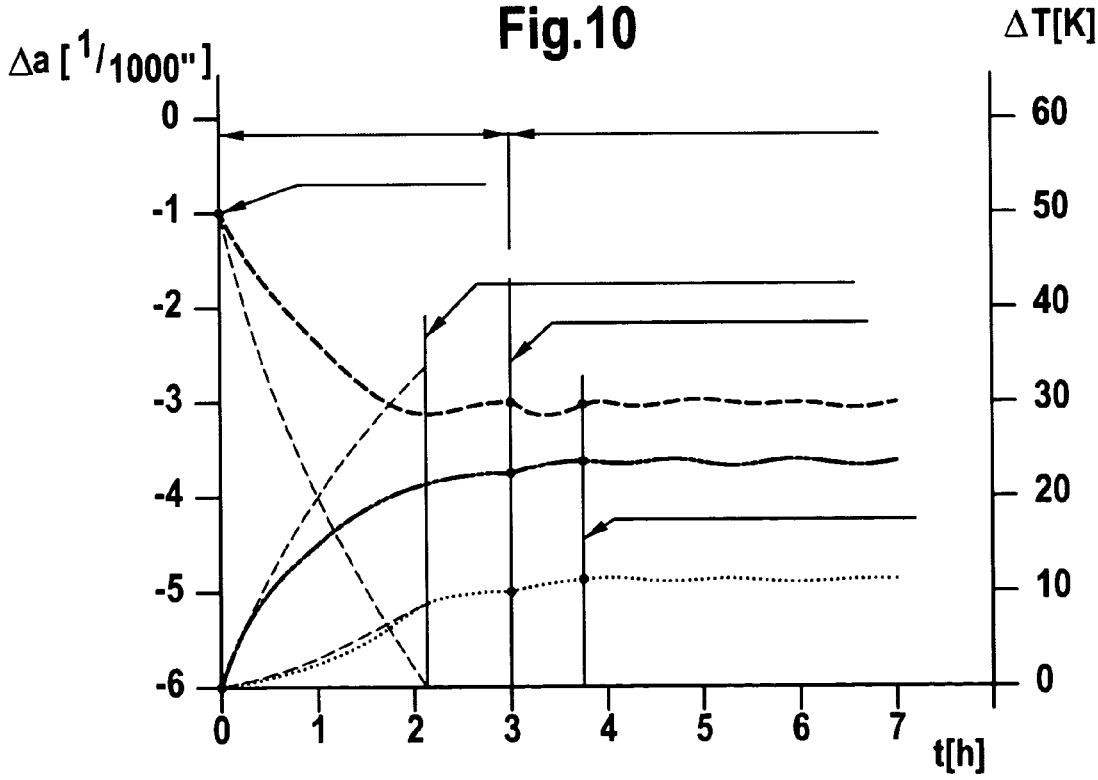

APPARATUS AT A SPINNING PREPARATION MACHINE, ESPECIALLY A FLAT CARD, ROLLER CARD, OR THE LIKE, HAVING A ROLLER, E.G. A CYLINDER, WHICH HAS A CYLINDRICAL CLOTHED PERIPHERAL SURFACE

CROSS REFERENCE TO RELATED APPLICATION

This application claims priority from German Patent Application No. 10 2005 038 401.3 dated Aug. 12, 2005, the entire disclosure of which is incorporated herein by reference.

BACKGROUND OF THE INVENTION

The invention relates to an apparatus at a spinning preparation machine, especially a flat card, roller card or the like, having a roller, for example a cylinder, which has a cylindrical clothed peripheral surface having at least one clothed and/or unclothed movable or stationary machine element located opposite the roller clothing and spaced radially therefrom, and having two fixed side panels, on which work elements, e.g. sliding bends for revolving flat bars, stationary carding elements, roller coverings, are mounted.

In a known apparatus, at least two measuring elements for detecting variables linked to the dimensions of the roller are provided, the measuring elements being connected to an electronic open-loop and closed-loop control device and a first measuring element being in the form of a temperature probe for the temperature of the roller surface and a second measuring element being in the form of a rotational speed sensor for the speed of the roller.

The effective spacing of the tips of a clothing from a machine element located opposite the clothing is called the carding nip. The latter element can also have a clothing, but could instead be formed by a casing segment having a guiding surface. The carding nip is a determining factor for the quality of carding. The size (width) of the carding nip is a fundamental machine parameter, which shapes both the technology (the fibre processing) and also the running performance of the machine. The carding nip is set to be as narrow as possible, (it is measured in tenths of a millimeter), without running the risk of a "collision" between the work elements. To ensure that the fibres are processed evenly, the gap must be as uniform as possible across the entire working width of the machine.

The carding nip is influenced particularly by the machine settings on the one hand and by the condition of the clothing on the other hand. The most important carding nip of the revolving flat card is located in the main carding zone, i.e. between the cylinder and the revolving flat assembly. At least one of the clothings adjoining the work spacing is in motion, more often than not both. In order to increase the production of the carding machine, efforts are made to select the operating speed of rotation and the operating speed of the moving elements as high as the technology of fibre processing will allow. The work spacing changes in dependence on the operating conditions. The change takes place in the radial direction (starting from the axis of rotation) of the cylinder.

In carding, ever larger amounts of fibre material are being processed per unit of time, which involves higher speeds of the work elements and higher installed capacities. With the work surface remaining constant, increasing throughput of fibre material (production) leads to greater generation of heat owing to the mechanical work. At the same time, however, the technological carding result (sliver uniformity, degree of cleaning, reduction of neps etc.) is continually being improved, which requires more active surfaces engaged in carding, and settings of these active surfaces closer to the cylinder (tambour). The proportion of synthetic fibres to be processed is continually increasing, with more heat, compared with cotton, being produced as a result of friction from contact with the work surfaces of the machine. The work elements of high-performance carding machines are today fully enclosed all round in order to comply with the high safety standards, prevent particle emission into the spinning works environment and minimise the need for maintenance of the machines. Gratings or even open, material-guiding surfaces that allow exchange of air belong to the past. The circumstances described appreciably increase the input of heat into the machine, whereas there is a marked decrease in the discharge of heat by means of convection. The resulting increased heating of high-performance carding machines leads to greater thermoelastic deformations, which have an influence on the set spacings of the active surfaces owing to the uneven distribution of the temperature field: the distances between cylinder and card top, doffer, fixed card tops and separation points decrease. In an extreme case the set nip between the active surfaces can close up completely as a result of thermal expansion, so that components moving relative to one another collide. The high-performance card concerned suffers considerable damage. Moreover, in particular the generation of heat in the working region of the card can lead to different thermal expansions when the temperature differences between components are too large.

Owing to the heat input under production conditions, the cylinder heats up more than the side panel. By using different materials for cylinder and side panel, the change in carding nip under production conditions can be substantially compensated. This is the case, for example, when the warming $\Delta T$ of the cylinder is approximately double the value of the warming $\Delta T$ of the side panel. When using different materials, a problem arises in particular when there are temperature differences that act on the machine from the outside, and the warming of the cylinder no longer corresponds to the calculated value of the side panel, e.g. double the value. Large changes in the carding nip are the result in particular of fluctuating external temperatures, because these act in equal measure on the cylinder and the side panel and then the carding nips change owing to the different coefficients of expansion of the materials used. Especially when the machine is at a standstill, big differences can occur during set-up operations as a function of the ambient temperature. For the machine operator, these changes of distance are imperceptible and the outcome of the set-up can consequently vary considerably. Even during operation of the machine, different ambient temperatures can lead to different carding nips and hence to different results in the product. Since the adjustments to the drive elements around the cylinder are performed substantially manually, the times from adjustment to start-up of the machine or to a quality evaluation are in some cases considerably far apart. Extreme temperature differences can thus lead both to dangerously narrow and to large carding nips, with the corresponding disadvantages.

In the case of a known apparatus (DE 29 48 825C), the diameter of the cylinder in the unreformed state (i.e. in practice before start-up of the machine and at room temperature) is designated D, whilst the diameter (indicated by a dot-dash line) of the cylinder in a state deformed by the influence of centrifugal force and/or the effect of heat is designated $D+\Delta D$. On the basis of the increase in diameter $\Delta D$, the distance between the cylinder surfaces in the underformed state, provided that a co-operating cylinder is not deformed, would be reduced by $$\frac{\Delta D}{2}:$$

an assumption that in many cases represents a good approximation. If the distance a in the underformed state of the cylinder were selected to be optimum, the distance $$a-\frac{\Delta D}{2}$$

obtaining while the cylinder is in its deformed state, would lie below the admissible limit, which would be very dangerous. It is proposed that both the influence of the rotational speed of the cylinder and the influence of warming are taken into account. For that purpose, a rotational speed sensor, which detects the rotational speed of the axle of the tambour, and a temperature sensor, which detects the temperature of the surface of the cylinder, are provided. These elements are connected by corresponding leads to the control device for actuating means, the control device being pre-programmed both in respect of the direct correlation between the diameter D of the tambour and its rotational speed and the direct correlation between the diameter and the temperature of the surface of the tambour casing. Allowances are thus made for both influences by the control device, which supplies electrical signals to the actuating means, which enlarge the spacing between the cylinders. The drawback is that only the changes in the diameter of the roller can be calculated. A further disadvantage is that the changes in diameter of just the one roller can be calculated, and not of the counter-element adjoining the carding nip.

It is an aim of the invention to produce an apparatus of the kind mentioned at the beginning, which avoids or mitigates the said disadvantages, which in particular allows an actual carding nip to be determined at any desired point in time and permits a comparison with a preset carding nip (reference value). A further objective is to adjust the carding nip as a function of temperature and rotational speed measurements to a desired value.

SUMMARY OF THE INVENTION

The invention provides an apparatus at a spinning preparation machine, having a clothed roller, at least one machine element located opposite the clothed roller and radially spaced therefrom, and lateral holding devices upon which at least one said machine element is supported, the apparatus comprising

- at least one temperature probe for the temperature of the roller surface;
- at least one rotational speed sensor for the speed of the roller;
- at least one temperature probe for the temperature of the holding devices; and
- a control device to which said speed sensor(s) and temperature probes are connected;
- wherein the control device is arranged for determining the spacing between the roller and a said machine element at the measured temperatures of the roller surface and the holding devices.

The inventive measures enable an actual distance, e.g. carding nip, to be determined at any time and compared with an adjusted distance (setting value). A particular advantage is that the difference between the actual distance at actual room temperature and the setting distance at a reference temperature can be determined if the roller and the side panels have different expansion behaviours in a radial direction. With the measured temperature differences at the relevant components (cylinder, side panels) of the card, the associated expansion coefficients of the materials used and the speed of rotation of the cylinder, it is possible to calculate the carding nip change in an advantageous manner. A particular advantage is that the carding nip can be set or re-set to a predetermined optimum, especially narrow, size (desired spacing), whereby the proportion of neps in the card sliver is substantially reduced.

Advantageously, the control device is capable of determining the difference between the actual spacing and a predetermined reference spacing. Advantageously, the control device is capable of determining the difference between the actual spacing at the actual temperatures for the roller and the holding devices (which are preferably side panels of the machine), and the reference spacing at the setting temperatures for the roller and the side panels (reference temperatures). Advantageously, a memory device is connected to the control device. Preferably, the memory device is manually activatable. Preferably, the memory device is resettable (reset module). Advantageously, the set temperatures for the roller and the side panels (reference temperatures) are enterable or storable in the memory device. Advantageously, the setting temperatures for the roller and the side panels correspond to the ambient temperature (room temperature). Advantageously, a further measuring element is in the form of a temperature probe for the ambient temperatures (room temperature). Advantageously, the measuring element for the temperature of the roller surface and the measuring element for the temperature of the side panels are connected to the memory device. Advantageously, the measuring element for the temperature of the roller surface and the measuring element for the temperature of the side panels are connected to the control device. Advantageously, the measuring element for the speed (n) of the roller is connected to the control device. An input device, for example, a keyboard may be connected to the control device. Advantageously, the functions of the dependency of the spacing change between the actual spacing and a setting spacing on the temperature-induced change in radius of the roller, the temperature-induced change in radius of the side panels and the speed-induced change in radius of the roller are enterable and storable in the control device. Functions which may advantageously be stored include one or more:

$$\Delta\alpha=\Delta r_2-\Delta r_{1T}-\Delta r_{1n}$$

$$\Delta r_{1T}=\alpha_1\cdot\Delta T_1$$

$$\Delta r_2=\alpha_2\cdot\Delta T_2$$

$$\Delta r_{1n}=f(n)$$

$$\Delta T_1=T_1-T_{1E}$$

$$\Delta T_2=T_2-T_{2E}$$

in which $\Delta r_{1T}$ is the temperature-induced change in radius of the roller, and the other parameters are as defined hereafter.

Advantageously, a display device, for example a monitor, printer or the like, is connected to the control device. The display device is advantageously capable of displaying the difference between the actual spacing and the reference spacing. Advantageously, the displayed differences are storable. Advantageously, a warning device, for example an optical or acoustic warning device, is connected to the control device. Advantageously, the reference spacing and the setting temperature for the roller and the side panels (reference temperature) are enterable in the memory with the machine switched off and/or without current. Advantageously, the temperature of the roller surface, the temperature of the side panels and the speed of the roller are enterable in the control device with the machine switched off and/or without current. Advantageously, the difference between the actual spacing and the reference spacing is determinable with the machine switched off and/or without current. Advantageously, the difference between the actual spacing and the reference spacing can be displayed with the machine switched off and/or without current. Preferably, a separate voltage source, for example a battery, is connected to the control device. Advantageously, a device for adjusting the desired spacing is provided. Advantageously, the device comprises an actuating means for changing the spacing. The actuating means is advantageously connected to a drive element, for example a drive means. The drive element is preferably connected to the control device. Preferably, the actuating means is capable of adjusting the desired spacing automatically. Preferably, the automatic adjustment of the desired spacing is effected in dependence on the determined spacing difference. Advantageously, the actuating means is controllable in dependence on the detected variables temperature of the roller surface, temperature of the side panels and speed of the roller. Preferably, the roller is the cylinder of a flat card or roller card. Preferably, the cylinder is enclosed. In one preferred embodiment, the cylinder is made at least in part of steel. In another preferred embodiment, the cylinder is made at least in part of fibre-reinforced plastics material. The machine element may be clothed and are, preferably, revolving flats. The clothed machine elements may be stationary flats. Advantageously, the machine elements is a roller, for example a doffer and/or licker-in. The machine elements may be unclothed and may be covering elements, for example covering plates. Other elements that may be present as unclothed machine elements include separating blades. The stationary holding devices are preferably the side panels located opposite the cylinder. The removal of heat from the cylinder may be different to that from the side panels. Advantageously, the side panels are made of a cast material, for example grey cast iron, aluminium. Advantageously, the spacing is influenced by the roller and by the at least one machine element. Advantageously, the spacing is influenced by the holding device (side panels) for the at least one machine element. Advantageously, the roller and the holding devices (side panels) consist of different materials. Advantageously, the material for the roller and for the holding devices (side panels) have different thermal expansion coefficients. Advantageously, more than one measuring element for the temperature of the roller surface is associated with the cylinder. Advantageously, the measuring element for the temperature of the roller surface is arranged on a covering element. Advantageously, the covering element is arranged in the wedge-shaped area between the cylinder and a roller. For example, the covering element may be arranged in a wedge-shaped area between the cylinder and the doffer. Advantageously, more than one measuring element for the temperature of the side panels is associated with the side panels. Advantageously, a measuring element for the temperature of the side panels is associated with each lateral side panel. Advantageously, the measuring element for the temperature of the side panels is arranged on fixing elements of the work members. Advantageously, the measuring element for the temperature of the side panels is arranged on the extension bend. Advantageously, the temperature of the roller surface is measurable inside the cylinder. In that case, the temperature from the interior of the cylinder is advantageously transmittable by radio to the memory and/or to the control device. The measuring element for the temperature is advantageously arranged in the vicinity of the periphery. Preferably, the adjustment of the desired spacing is effected by iteration. Expediently, during the warm-up phase of the equipment, the production rate of the card is less than during the operating phase.

The invention also provides an apparatus at a spinning preparation machine, especially a flat card, roller card or the like, having a roller, for example a cylinder, which has a cylindrical clothed peripheral 1 surface, having at least one clothed and/or non-clothed movable or stationary machine element located opposite the roller clothing and spaced radially distance therefrom and two fixed lateral holding devices (side panels), on which work elements, e.g. sliding bends for revolving flat bars, stationary carding elements, roller coverings are mounted, in which at least two measuring elements for detecting variables linked to the dimensions of the roller are provided, the measuring elements being connected to an electronic open-loop and 2closed-loop control device and a first measuring element being in the form of a temperature probe for the temperature of the roller surface and a second measuring element being in the form of a rotational speed sensor for the speed of the roller, wherein a third measuring element is in the form of a temperature probe for the temperature of the holding devices (side panels) and the electronic control and regulating device is capable of determining the actual spacing at the actual temperatures for the roller and the side panels.

The invention further provides a method of determining a spacing between a roller and a counter-element in a spinning preparation machine comprising determining the temperature of the roller surface, determining the speed of rotation of the roller, determining the temperature of a holding device for the counter-element and using said determined temperatures and speed to determine the actual spacing.

BRIEF DESCRIPTION OF THE DRAWINGS

FIG. 9 shows the dependence of the difference Δa on the time and a diagram of the optimisation of the carding nip at the working point of the machine, and FIG. 10 shows the dependence of the difference Δa on the time and a diagram of the controlled warming of the machine.

DETAILED DESCRIPTION

Figure 1:
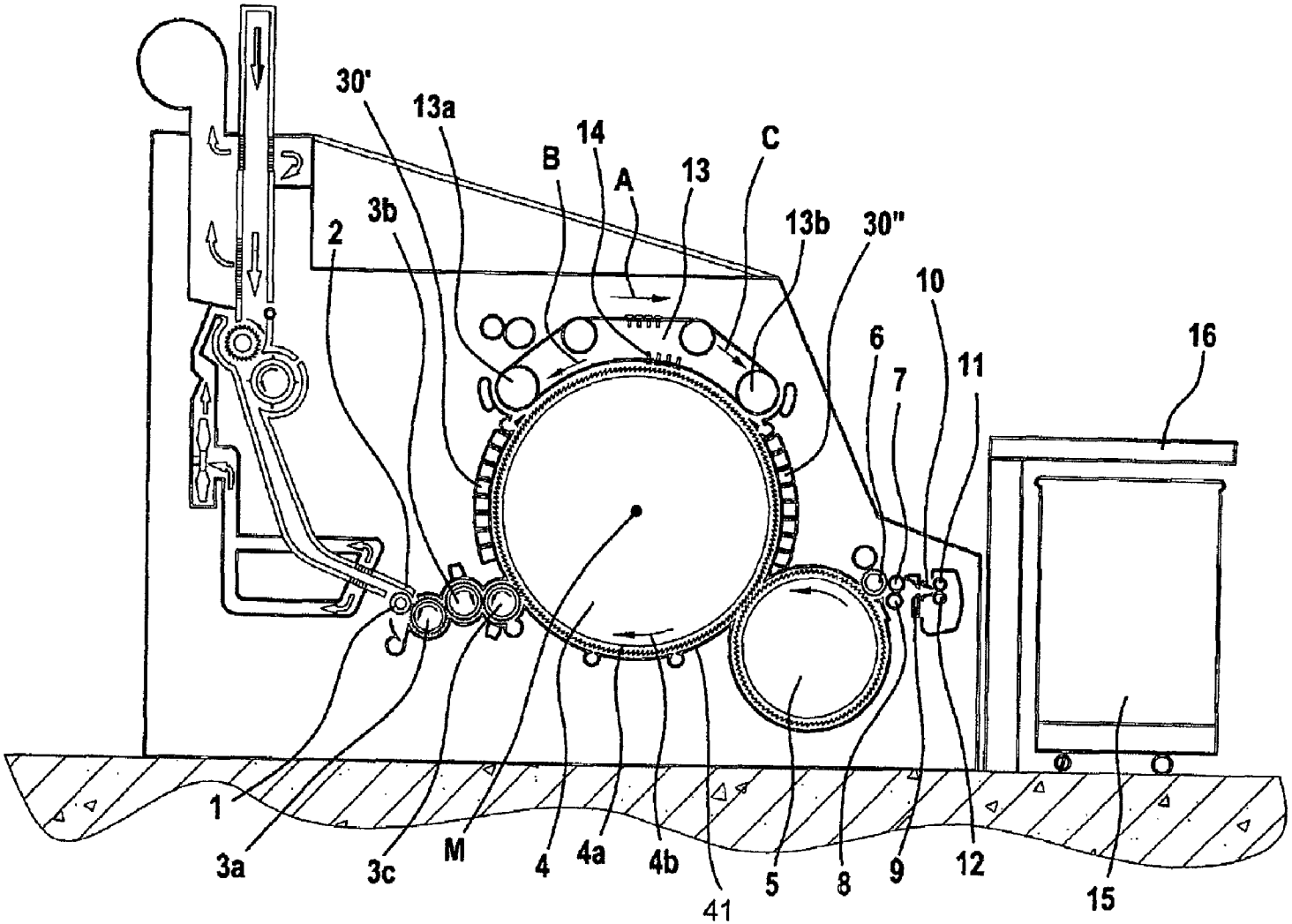
FIG. 1 is a schematic side view of a card with an apparatus according to the invention.

FIG. 1 shows a card, for example, a card TC 03 (Trademark), made by Trützschler GmbH & Co. KG of Mönchengladbach, Germany, with feed roller 1, feed table 2, licker-ins 3*a*, 3*b*, 3*c*, cylinder 4, doffer 5, stripping roller 6, squeezing rollers 7, 8, web-guide element 9, web funnel 10, take-off rollers 11, 12, revolving flat 13 with flat guide rollers 13*a*, 13*b* and flat bars 14, 14', 14", can 15 and can coiler 16. The directions of rotation of the rollers are shown by respective curved arrows. The letter M denotes the midpoint (axis) of the cylinder 4. The reference numeral 4*a* denotes the clothing and reference numeral 4*b* denotes the direction of rotation of the cylinder 4. The letter B denotes the direction of rotation of the revolving flat 13 in the carding position and the letter C denotes the reverse transport direction of the flat bars 14; 30', 30" denote stationary carding elements and 41 denotes a cover underneath the cylinder 4. The letter A denotes the work direction.

Figure 2:
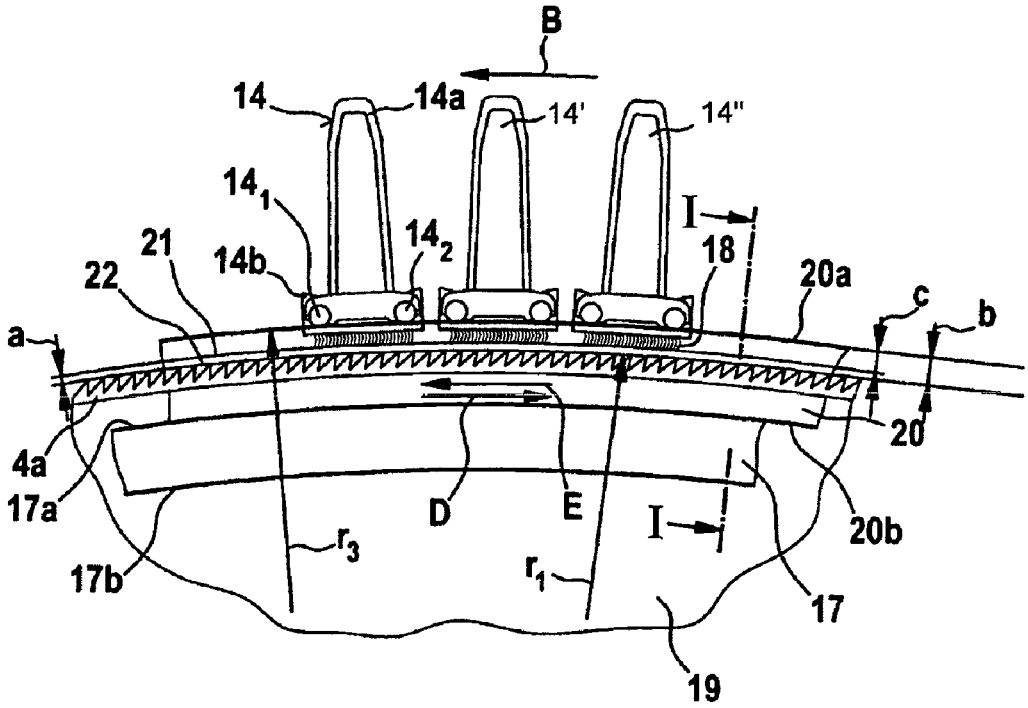
FIG. 2 is a side view of the card of FIG. 1 showing flat bars of the revolving flat and a segment of a slideway, a flexible bend, a side panel and the cylinder as well as the carding nip between the clothings of the flat bars and the cylinder clothing.
Figure 3:
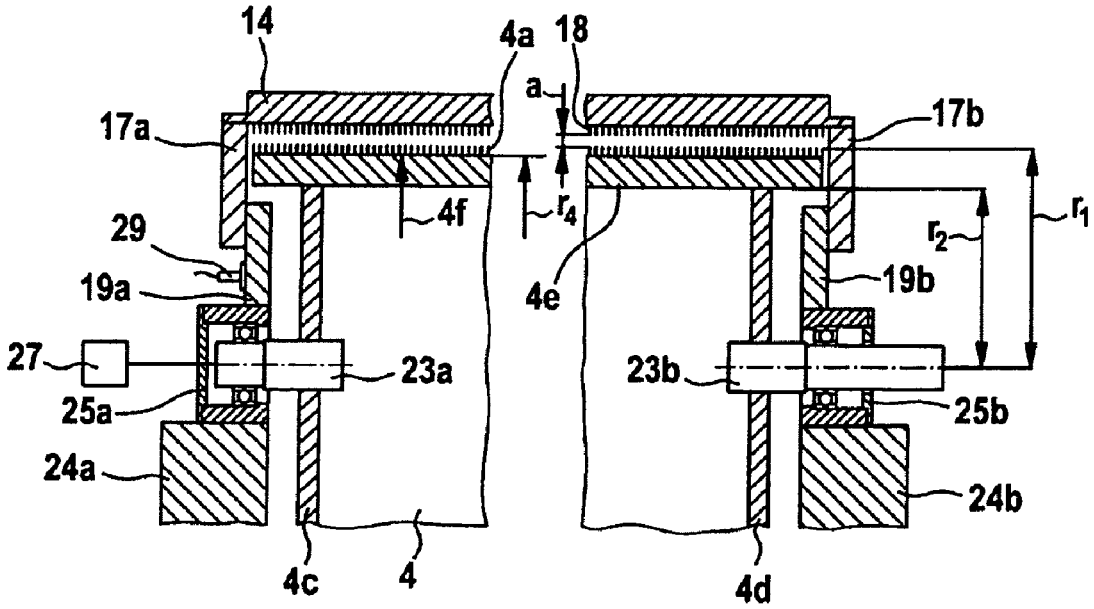
FIG. 3 is a section I-I through the slideway shown in FIG. 2 with flexible bends and side panels as well as an element for measuring the temperature of a side panel.

In accordance with FIG. 2, on each side of the card a flexible bend 17 having several adjusting screws is secured by screws laterally to the side panel 19*a*, 19*b* (see FIG. 3). The flexible bend 17 has a convex outer surface 17*a* and a lower surface 17*b*. Above the flexible bend 17, there is a slideway 20, for example, of low-friction plastics material, which had a convex outer surface 20*a* and a concave inner surface 20*b*. The concave inner surface 20*b* lies on top of the convex outer surface 17*a* and is able to slide on this in the direction of the arrows D, E. Each flat bar 14 comprises a heel part 14*a* and a carrier member 14*b*. Each flat bar 14 has at both ends a respective flat head, each of which comprises two steel pins $\mathbf{14}_1$, $\mathbf{14}_2$. The parts of the steel pins $\mathbf{14}_1$, $\mathbf{14}_2$ projecting beyond the end faces of the carrier member 14*b* slide on the convex outer surface 20*a* of the slideway 20 in the direction of arrow B. A clothing 18 is mounted on the lower surface of the carrier member 14*b*. The reference numeral 21 denotes the tip circle of the card flat clothings 18. On its circumference, the cylinder 4 has a cylinder clothing 4*a*, for example, a saw-tooth clothing. The tooth height of the saw-teeth is, for example, h=2 mm. The reference numeral 22 denotes the tip circle of the cylinder clothing 4*a*. The spacing (carding nip) between the tip circle 21 and the tip circle 22 is denoted by the letter a, and is, for example, 3/1000". The spacing between the convex outer surface 20*a* and the tip circle 22 is denoted by the letter b. The spacing between the convex outer surface 20*a* and the tip circle 21 is denoted by the letter c. The radius of the convex outer surface 20*a* is denoted by $r_3$ and the radius of the tip circle 22 is denoted by $r_1$. The radii $r_1$ and $r_3$ intersect at the mid-point M of the cylinder 4. The reference numeral 19 denotes the side panel.

FIG. 3 shows a part of the cylinder 4 with a cylindrical surface 4*f* of the casing 4*e* and cylinder end discs 4*c*, 4*d* (radial supporting elements). The surface 4*f* is provided with a clothing 4*a*, which in this example is in the form of wire with saw-teeth. The saw-tooth wire is drawn onto the cylinder 4, i.e. is wound round in tightly adjacent turns between side flanges (not shown) in order to form a cylindrical work surface equipped with tips.

Fibres are intended to be processed as evenly as possible on the work surface (clothing).

The carding work is carried out between the clothings 18 and 4*a* located opposite one another. It is influenced substantially by the position of the one clothing with respect to the other and by the clothing spacing a between the tips of the teeth of the two clothings 18 and 4*a*. The working width of the cylinder 4 is a determining factor for all other work elements of the card, especially for the revolving flats 14 or stationary flats 30', 30", which, together with the cylinder 4, card the fibres evenly across the entire working width. In order to be able to perform even carding work across the entire working width, the settings of the work elements (including those of additional elements) across this working width must be maintained. The cylinder 4 itself, however, can be deformed as a result of drawing-on the clothing wire, by centrifugal force or by the heat generated by the carding process. The shaft journals 23*a*, 23*b* of the cylinder 4 are mounted in bearings 25*a*, 25*b*, which are attached to the stationary machine frame 24*a*, 24*b*. The diameter, for example 1250 mm, of the cylindrical surface 4*f*, that is to say twice the radius $r_4$, is an important dimension of the machine, and it becomes larger during operation as a result of the heat of work. The side panels 19*a*, 19*b* are secured to the two machine frames 24*a* and 24*b* respectively. The flexible bends 17*a*, 17*b* are secured to the side panels 19*a*, 19*b* respectively. Furthermore, the temperature probe 29 for measuring the temperatures ($T_{2E}$ and $T_2$) is arranged on the outside of the side panel 19*a*. The circumferential speed of the cylinder 4 is, for example, 35 m/sec.

When heat is generated in use in the carding nip a between the clothings 18 (or in the carding nip d between the clothings 38*a*, 38*b*) and the cylinder clothing 4*a* by carding work, especially at a high production rate and/or when processing synthetic fibres or cotton-synthetic fibre blends, the cylinder casing 4*e* undergoes expansion, that is to say the radius $r_4$ increases and the carding nip a or d decreases. The heat is directed via the cylinder casing 4*e* into the radial supporting elements and the cylinder end discs 4*c* and 4*d*. The cylinder end discs 4*c*, 4*d* consequently also undergo expansion, that is to say their radius increases. The cylinder 4 is virtually completely encased (enclosed) on all sides: in a radial direction by the elements 14, 30', 30", 41 (see FIG. 1) and towards both sides of the card by the elements 17*a*, 17*b*, 19*a*, 19*b*, 24*a*, 24*b*. Scarcely any heat from the cylinder 4 is therefore radiated to the outside (to the atmosphere). Nevertheless, in particular the heat of the large-area cylinder end discs 4*c*, 4*d* is transmitted by radiation to the large-area side panels 19*a*, 19*b* to a considerable extent, from where the heat is radiated outwards to the colder atmosphere. This radiation causes the side panels 19*a*, 19*b* to expand less than the cylinder end discs 4*c*, 4*d*, which leads to a reduction in the carding nip a (FIG. 2) and in the carding nip d (see FIG. 7*a*) ranging from undesirable (as regards the carding result) to dangerous. The carding elements (flat bars 14) are mounted on the flexible bends 17*a*, 17*b* and the stationary carding elements 30 are mounted on the extension bends 32*a*, 32*b* (See FIG. 7*b*), which in turn are fixed to the side panels 19*a*, 19*b*. On being heated, the lifting of the flexible bends 17*a*, 17*b*—and hence of the clothings 18 of the flat bars 14—increases less than the expansion of the radius $r_4$ of the cylinder casing 4*e*—and hence of the clothing 4*a* of the cylinder 4—which results in narrowing of the carding nip a. The cylinder casing 4*e* and the cylinder end discs 4*c*, 4*d* are made of steel, for example St 37, having a longitudinal thermal expansion coefficient $\alpha=11.5\cdot10^{-6}$ [1/° K]. In order to compensate for the relatively different expansion of the cylinder end discs 4*c*, 4*d* and the cylinder casing 4*e*, on the one hand, and of the side panels 19*a*, 19*b* (due to impeded radiation into the atmosphere because of encasing of the cylinder 4 and due to free radiation into the atmosphere from the side panels) on the other hand, the side panels consist, for example, of aluminium having a longitudinal thermal expansion coefficient $\alpha=23.8\cdot10^{-6}$ [1/° K]. According to a different construction, the cylinder 4 can also consist of glass fibre-reinforced plastics material and the side panels 19 can consist, for example, of grey cast iron GG having a longitudinal thermal expansion coefficient $\alpha=10.5\cdot10^{-6}$ [1/° K]. In both cases, the radial expansion of the side panels 19*a*, 19*b* is greater than the radial expansion of the cylinder 4. By that means, the expansion of the cylinder 4 remains the same, but the machine elements, e.g. flat bars and/or carding bars, are displaced or lifted radially outwards. The undesirable reduction in the carding nip a owing to thermal influences is thereby considerably lessened or reduced.

Figure 4:
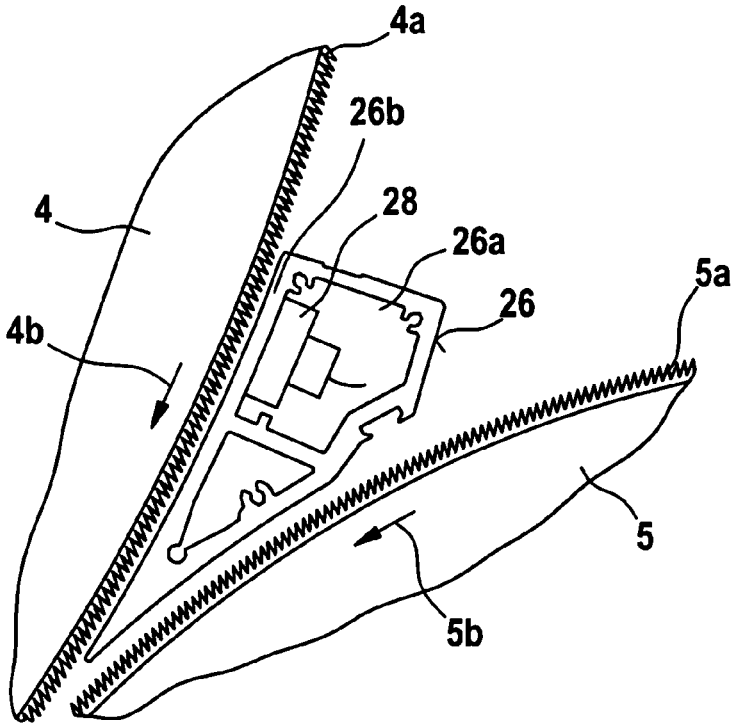
FIG. 4 shows a covering element in the wedge-shaped area between the cylinder and the doffer with an element for measuring the temperature of the cylinder surface.

In the arrangement shown in FIG. 4, in the wedge-shaped area between the cylinder 4 and the doffer 5 there is a covering element 26 (extruded aluminium element), in the inner space 26*a* of which there is a temperature probe 28 for measuring the temperatures ($T_{1E}$) and ($T_1$) of the surface of the cylinder 4. The temperature probe 28 is secured to the wall face 26*b* opposing the cylinder clothing 4*a*, to be precise, on the side of the wall face 26*b* remote from the cylinder clothing 4*a*. The doffer 5 includes a doffer clothing 5*a* and a working direction 5*b*.

Figure 5:
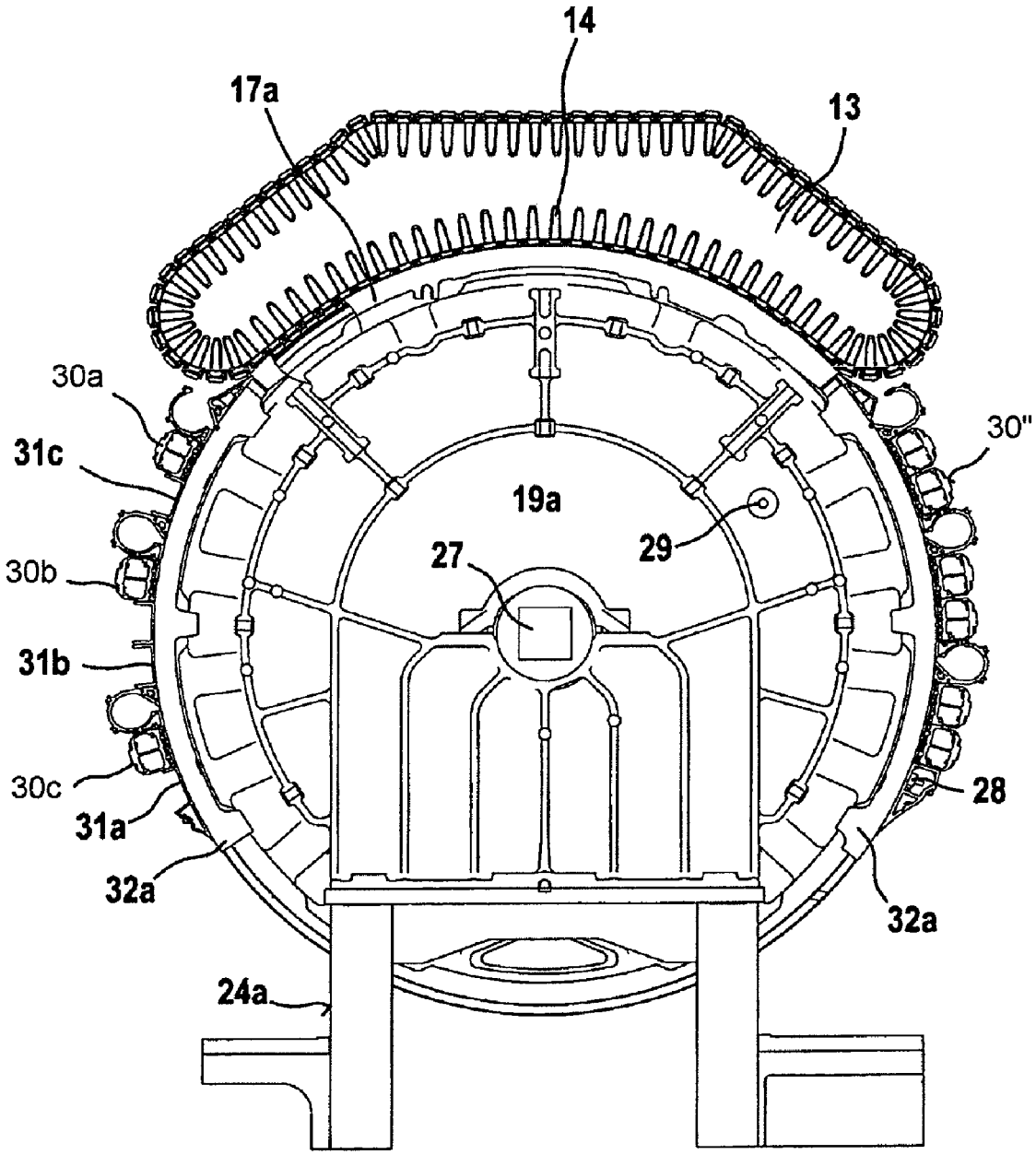
FIG. 5 shows in side view a side panel with flexible bend, cylinder, extension bend, stationary carding element and revolving flat bars as well as an element for measuring the temperature at the side panel and an element for measuring the temperature of the cylinder surface.

In the embodiment of FIG. 5, three non-moving stationary carding elements 30*a*, 30*b*, 30*c* and three unclothed cylinder casing elements 31*a*, 31*b*, 31*c* are provided between the licker-in 3 and flat guide roller 213*a*. The stationary carding elements 30 have a clothing 38*a*, 38*b*, in accordance with FIG. 7*a*, which lies opposite the cylinder clothing 4*a*. The carding nip between the clothing 38*a*, 38*b* and the cylinder clothing 4*a* is denoted by the letter d. The stationary carding elements 31*a* to 31*c* are mounted by means of screws and the cover elements 30*a* to 30*c* are mounted by means of screws (not illustrated) on an extension bend 32*a* (only the extension bend 32*a* on one side of the card is shown in FIG. 5), which in turn is fastened by means of screws 3 to the card side panel 19*a*, 19*b* (only 19*a* is shown in FIG. 5) on each side of the card. The flexible bends 17*a*, 17*b* (only 17*a* is shown in FIG. 5) are fastened by means of screws 37 (see FIG. 6*b*) to the side panel 19, 19*b* respectively. The temperature probe 29 for the temperatures ($T_{2E}$ and $T_2$) of the side panel 19*a* is fastened to the outside of the side panel 19*a*.

Figure 6A:
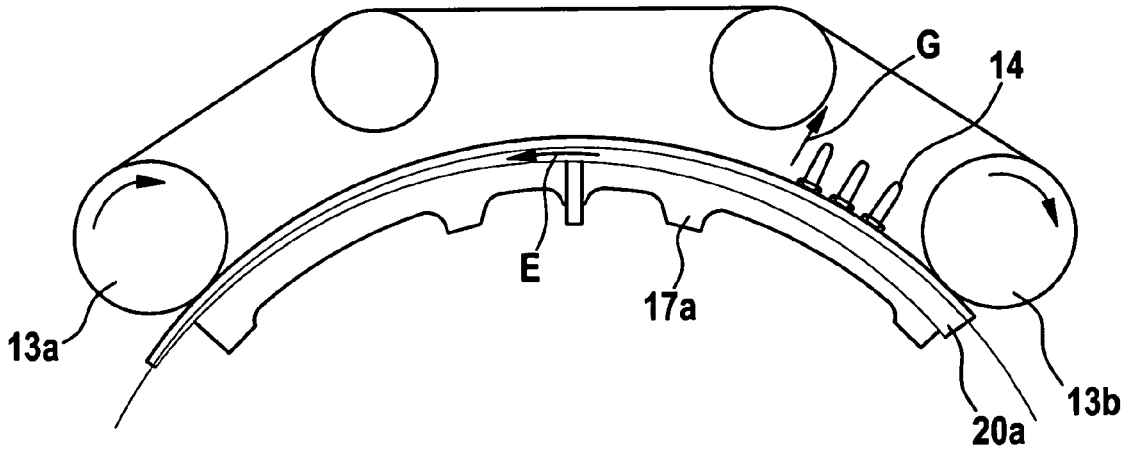
FIG. 6*a* shows a side view of the flexible bend and the revolving flat with slideway displaced in direction E and flat bars shifted radially in direction G.

In FIG. 6*a*, the displacement of the slideway 20*a* on the flexible bend 17*a* in the direction of arrow E is shown. As a result of the displacement, for example, by 50 mm, the spacing a between the flat clothings 18*a* and 18*c*, that is to say the spacing between the tip circles, is increased. Because the slideway 20 is displaced in direction E, the flat bars 14 are raised in direction G. The flat bars 14 are moved slowly in direction B between the flat guide roller 13*a* and the flat guide roller 13*b* by a drive belt (not shown), are then diverted and returned again on the opposite side.

Figure 6B:
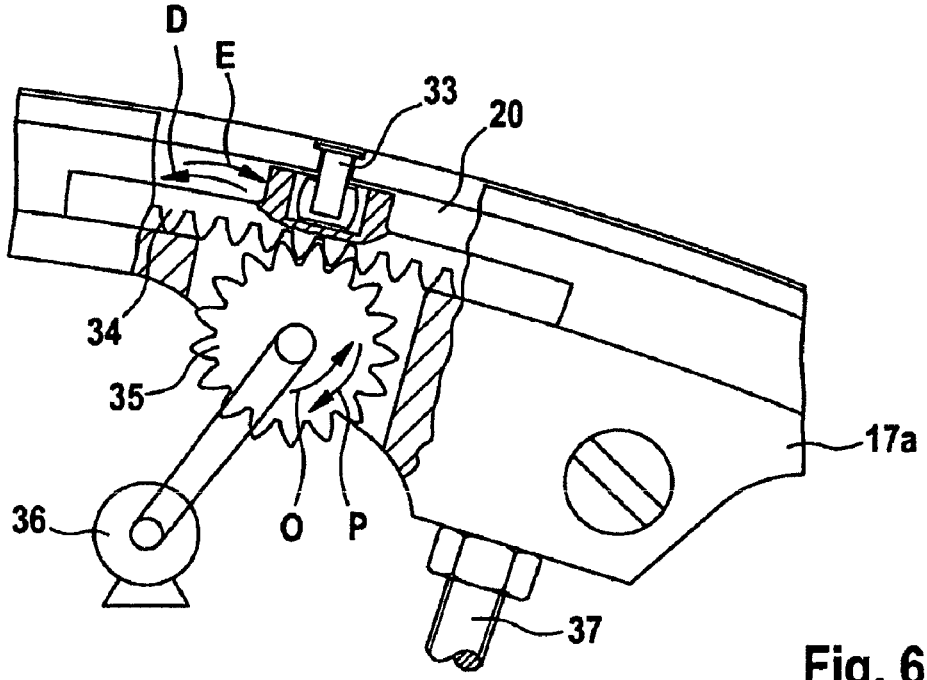
FIG. 6*b* shows a motor-driven displacement device for the slideway.

In accordance with FIG. 6*b*, on the slideway 20 there is mounted a driver element 33 that is connected to a toothed rack 34 which is engaged by a gearwheel 35 rotatable in the directions 0, P, which is driven by a drive means 36, for example a reversing motor, whereby the slideway 20 is displaceable in the direction of the arrows D, E. Connected to the drive means 36 is a setpoint entry means (not shown), with which a desired narrowest carding nip (a3), for example 3/1000" can be preset (setpoint). The adjustment can also be effected by an electronic open-loop and closed-loop control device 44 (see FIG. 8), with a setpoint memory, which controls the servomotor 36.

The setting means according to FIGS. 6*a*, 6*b* can be a Trützschler Precision Flat Setting System (PFS). Setting can be effected manually or by motor (motor 36).

Using the setting means according to FIGS. 6*a*, 6*b*, a setpoint (a3) for the carding nip can be adjusted after the heat-induced expansion of the cylinder 4.

Figure 7A:
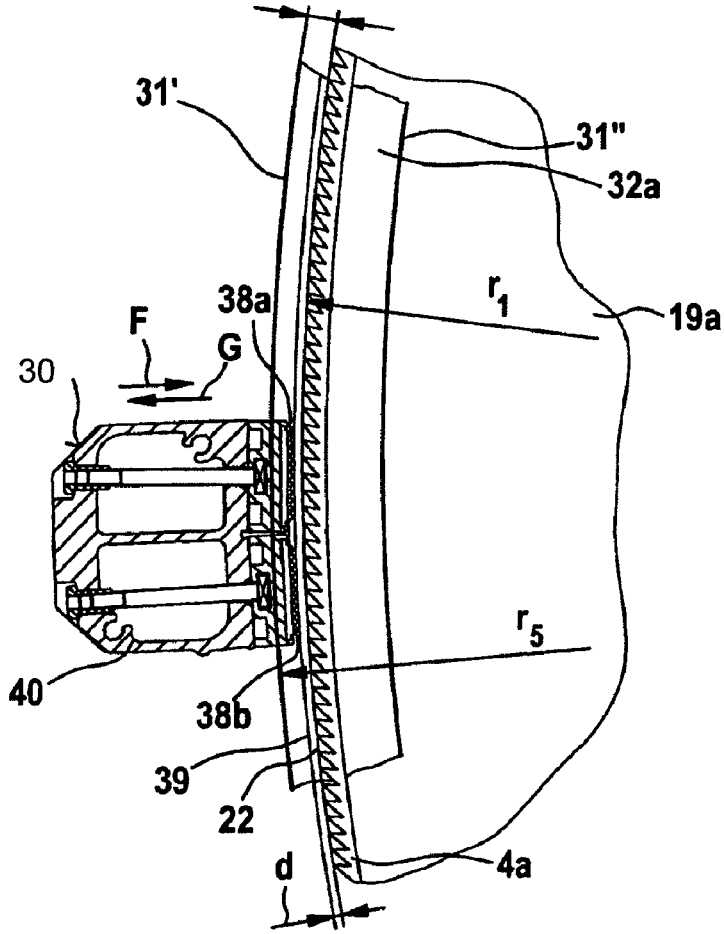
FIG. 7*a* shows a stationary carding segment, a segment of a side panel with space between the carding segment clothing and cylinder clothing.

In accordance with FIG. 7*a*, on each side of the card an approximately semi-circular, rigid side panel 19*a* is fixed laterally to the machine frame 24*a*; a curved, rigid supporting element 32*a* is integrally cast on the outside of the side panel in the region of the periphery thereof, and has a convex outer surface 32' as its support surface and an underside 31' and 31".

At their two ends, stationary carding elements 30 (see FIG. 1) have bearing surfaces, which are located on the convex outer surface $32^I$ of the supporting element 32*a*. Carding clothings 38*a*, 38*b* are mounted on the undersurface of the carding segment 30. The reference numeral 22 denotes the tip circle of the clothings 38*a*, 38*b*. On its circumference the cylinder 4 has a cylinder clothing 4*a*, for example, a saw-tooth clothing. The reference numeral 22 denotes the tip circle of the cylinder clothing 4*a*. The spacing between the tip circle 39 and the tip circle 22 is denoted by the letter d, and is, for example, 0.20 mm. The radius of the convex outer surface $32^I$ is denoted by $r_5$ and the radius of the tip circle 22 is denoted by $r_1$. The radii $r_1$ and $r_5$ intersect at the mid-point M (see FIG. 1) of the cylinder 4.

The stationary carding element 30 shown in FIG. 7*a* consists of a support 40 and two carding elements, which are arranged one behind in the other in the direction of rotation (arrow 4*b*) of the cylinder, the clothings 38*a*, 38*b* of the carding elements and the clothing 4*a* of the cylinder 4 being located opposite one another. The wedge-shaped setting means shown in FIG. 7*b* effects the displacement of the support 4*a* in an axially parallel direction (arrow H, I) in relation to the cylinder axis M, the result being that on displacement the carding segment 30 is shifted in the direction of the arrows F, G. The spacing d between the clothings 39*a*, 38*b* of the carding elements and the cylinder clothing 4*a* is consequently simply and precisely adjustable.

FIG. 7*a* shows the position of the carding element 30 with the carrier member 40 and the clothings as well as the cylinder 4 at a relatively low temperature. The length of the carrier member 40 is denoted by $1_1$ and the carding spacing between the clothings 38*a*, 38*b* and the cylinder clothing 4*a* is denoted by the letter d. When heat is generated in use in the carding nip d between the clothings 38*a*, 38*b* and the cylinder clothing 4*a* by carding work, especially at a high production rate and/or when processing synthetic fibres or cotton-synthetic fibre blends, the cylinder casing undergoes expansion, that is to say the radius $r_1$ (see FIG. 7*a*) increases and the carding nip d decreases. The heat is directed via the cylinder casing into the radial supporting elements, the cylinder end discs. The cylinder end discs consequently also undergo expansion, that is to say their radius increases. The cylinder 4 is virtually completely encased (enclosed) on all sides: in a radial direction by the elements 14, 30', 30", 41 (see FIG. 1) and towards both sides of the card by the elements 17*a*, 17*b*, 19*a*, 19*b*, 24*a*, 24*b*. Scarcely any heat from the cylinder 4 is therefore radiated to the outside (to the atmosphere). The cylinder casing and the cylinder end discs are made of steel, for example St 37, having a longitudinal thermal expansion coefficient $\alpha=11.5\cdot10^{-6}$ [1/° K]. In addition, the aluminium carrier member 40 likewise expands radially, which results in a further narrowing of the carding nip d. The carrier member 40 is made of aluminium having a longitudinal thermal expansion coefficient of $\alpha=23.8\cdot10^{-6}$ [1/° K]. Owing to this high longitudinal thermal expansion coefficient, the carrier member 40 expands substantially in the direction of the arrow I, that is to say, in the longitudinal direction.

Figure 7B:
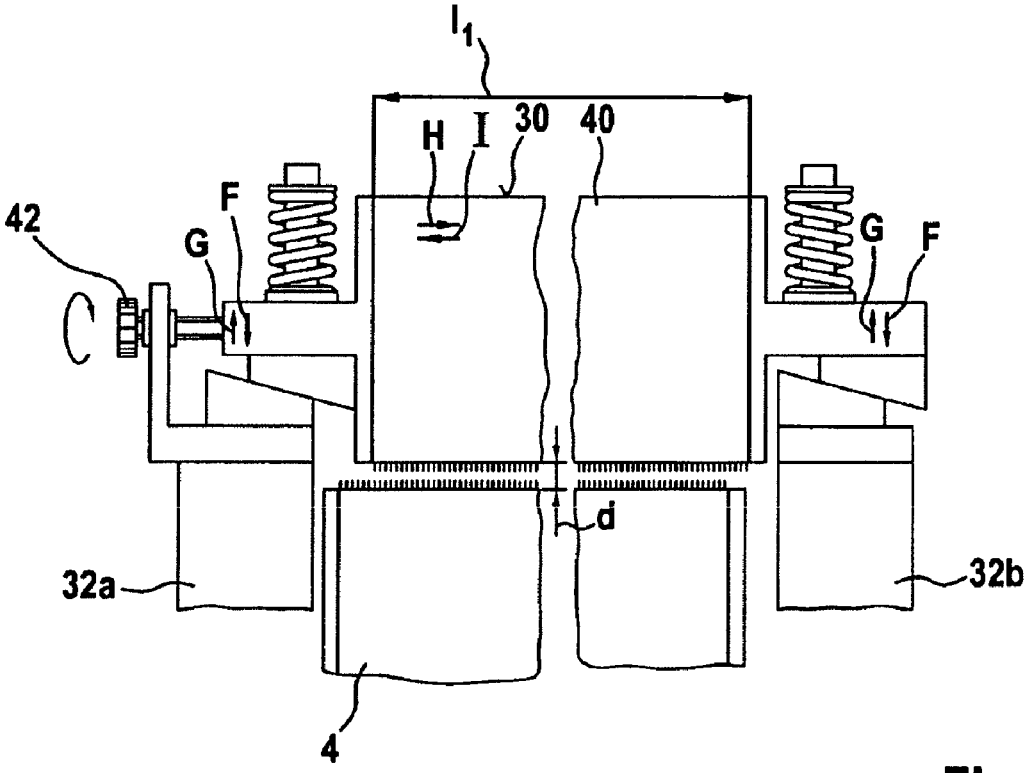
FIG. 7*b* shows a front view of the carding segment according to FIG. 7*a*, in which on both sides in the region of the end parts or the supports there are co-operating oblique faces, wherein the carding element, on becoming warm, is slidable axially parallel to the cylinder and displaceable radially with respect to the cylinder by means of a set-screw.

FIG. 7*b* shows the position of the carding element 30 with the carrier member 40 as well as the cylinder 4 at a relatively high temperature. The length of the carrier member 40 has increased in value. Owing to the lengthwise thermal expansion of the carrier member 40 in the direction of arrows H, I, on both sides actuators are actively displaced outwards (arrows) and upwards with their oblique surfaces on the oblique surfaces of co-operating actuators by means of the set-screw 42. Displacement of the carding element 30 in the direction of the arrow G is effected against the pressure of the springs. By this means, the expansions of the cylinder 4 and of the carrier member 40 in a radial direction are compensated, such that the carding nip d remains the same. By means of the set-screw 42 a desired value for the carding nip d can be set after the thermal expansion. A positioning motor (not shown) can be connected to the set-screw 42, whereby the adjustment is effected by motor. Such a motor can be connected to the control and regulating device 45 (see FIG. 8).

Figure 8:
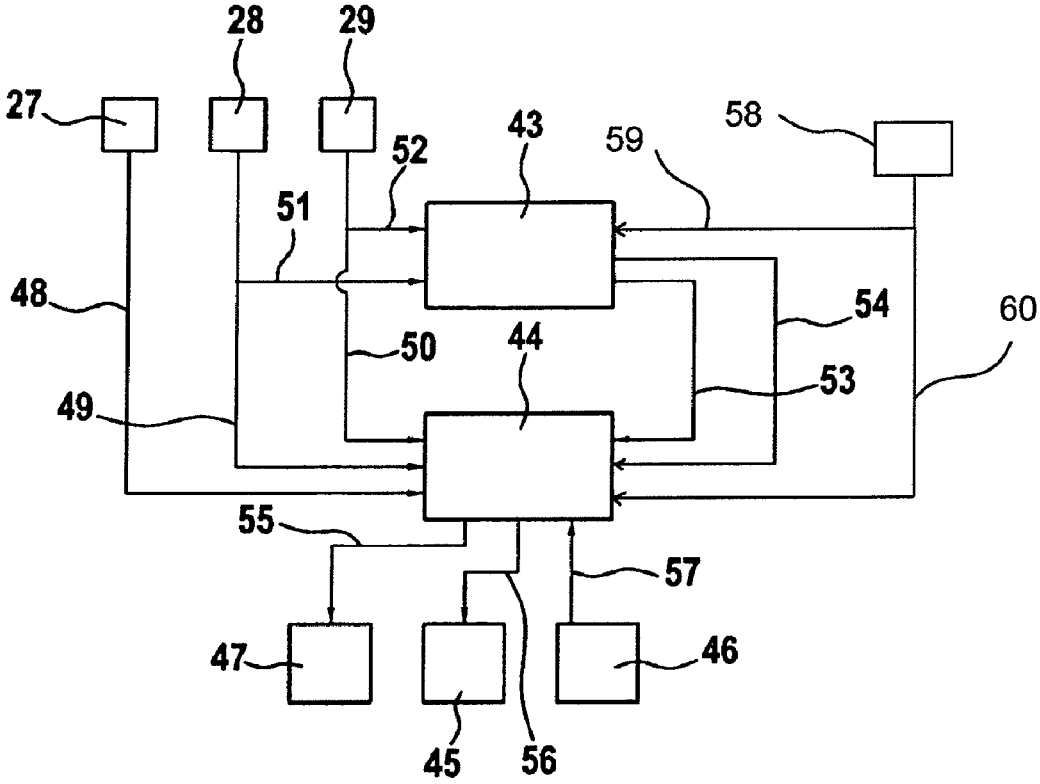
FIG. 8 shows schematically a block diagram with an open-loop and closed-loop control device, memory device, measuring elements in the form of a temperature probe for the roller surface, the roller rotational speed and a temperature probe for the side panels, output and display device, input device and actuating means.

In accordance with FIG. 8, an electronic open loop and closed-loop control device 44, for example a microcomputer with microprocessor, is provided, which can be the machine control of the card (FIG. 1). A rotary speed sensor 27 (see FIGS. 3 and 5) for the speed of the cylinder 4, a temperature probe 28 (see FIGS. 4 and 5) for the temperature ($T_1$) of the casing the cylinder 4 and a temperature sensor 29 (see FIGS. 3 and 5) for the temperature ($T_2$) of the side panel 19 are connected to the open-loop and closed-loop control device 44 by way of electrical leads 48, 49 and 50 respectively. The temperature probes 28 and 29 and the leads 49 and 50 are connected to a memory 43 via branch leads 51, 52. The memory 43 is connected via leads 53 and 54 to the open-loop and closed-loop control device 44. Furthermore, a display means 45, for example, a monitor, an input device 46 and an actuating means 47, for example a motor 36, are connected to the open-loop and closed-loop control device 44 via leads 56, 57 and 55 respectively.

Detecting the temperature of components of a card can be achieved simply and robustly. Rotational speed measurement is a fixed element of the machine control. Four parameters are recorded online:

The temperature ($T_1$) of the cylinder 4 (represented by a cover profile on the doffer side)

The temperature ($T_2$) of the cylinder side panel 19

Ambient temperature (T)

Rotational speed (n) of the cylinder 4.

The cylinder temperature ($T_1$) is recorded to calculate the linear expansion Δr of the cylinder 4. The starting point is the temperature ($T_{1E}$) when setting up the machine.

The side panel temperature ($T_2$) is recorded to calculate the linear expansion of the side panel 19. The starting point is the temperature ($T_{2E}$) when setting up the machine.

The rotational speed of the cylinder n is recorded to calculate the dynamic widening (Δr) of the cylinder 4 under the selected operating speed.

The ambient temperature (T) is registered to dispense with manual inputs. The ambient temperature is accepted to be the set-up temperature, since this is relatively constant during the operation of spinning works. The ambient temperature (T) may be measured by temperature probe 58 and connected by lead lines 59 and 60 to memory 43 and the open-loop and closed-loop control device 44, respectively. If a starting point is stored after setting the machine (if possible in the cold state), measurement of the ambient temperature is not necessary.

From the parameters ($T_{1E}$, $T_{2E}$, $T_1$, $T_2$) a change (Δa) in the carding nip a can be calculated. The dynamic cylinder widening (Δr) is proportional to the measured speed n and decreases the carding nip a as the speed n increases. The relative expansion of the cylinder 4 and side panels 19 can be calculated simply using the detected temperature.

In operation, the phases are as follows:

a) Setting-Up Phase

The machine is off.

The reference temperature ($T_{1E}$) for the cylinder 4 and reference character ($T_{2E}$) for the side panel 19 are determined using the temperature probes 28 and 29 respectively and entered in the memory 43, for example, reset module. In addition, a reference spacing $a_1$ for the carding nip, for example 5/1000", is set. The measurement of the carding nip $a_1$ is entered in the memory 43 and/or via the input device 46 into a memory of the open-loop and closed-loop control device 44. The memory 43 and the open-loop and closed-loop control device 44 are connected to a separate voltage source, for example a battery, in order to store temperatures ($T_{1E}$, $T_{2E}$) and spacing $a_1$.

b) Operating Phase

The machine is switched on and, after a certain time, the warm-up phase gives way to the operating phase.

In the operating phase, at specific times (permanently or cyclically) the following are measured and entered:

The actual speed n is measured with the speed sensor 27 and entered in the open-loop and closed loop control device 44.

The actual temperatures ($T_{1E}$, $T_{2E}$) are measured with the temperature probes 28 and 29 respectively and entered in memory 43 and in the open-loop and closed-loop control device 44.

The following calculation steps are carried out:

1. In the open-loop and closed-loop control device 44 the speed-induced change in spacing ($\Delta a_n$), the change in cylinder temperature ($\Delta T_1$), and the change in the side panel temperature ($\Delta T_2$) are calculated:

$\Delta a_n$=speed-induced change in spacing $\Delta a_n$=f(n)

e.g.: $\Delta a_n=n_2\cdot k_1+n\cdot k_2$ $\Delta T_1$=change in the cylinder temperature from a manually determined time, e.g. setting time $\Delta T_1=T_1-T_{1E}$ $\Delta T_2$=change in the side panel temperature from a manually determined time, e.g. setting time $\Delta T_2=T_2-T_{2E}$ 2. Subsequently the difference (Δa) between the actual spacing $a_2$ at the actual temperatures ($T_1$, $T_2$) and the reference spacing $a_1$ at the setting temperatures ($T_{1E}$ and $T_{2E}$) (reference temperatures) is calculated:

$\Delta r_1$=temperature-induced change in cylinder radius $\alpha_1$=longitudinal expansion coefficient for cylinder material $$\Delta r_1=\alpha_1 \cdot \Delta T_1.$$

$\Delta r_2$=temperature-induced change in the side panel radius $r_2$ at the bearing surface for, for example, stationary carding elements $\alpha_2$=longitudinal expansion coefficient for side panel material $$\Delta r_2=\alpha_2 \cdot \Delta T_2$$

$$\Delta a=\Delta r_2-\Delta r_1-\Delta a_n$$

The calculated difference Δa is indicated on the monitor 45.

3. Finally, the reset spacing A, by which the desired spacing (a3) is to be adjusted, is calculated:

$$\Delta a=a_2-a_1$$

$$a_2=\Delta a+a_1$$

$$a_3=A+a_2$$

$$A=a_3-a_2$$

in which:

Δa=difference between the actual spacing $a_2$ and the reference spacing $a_1$ $a_3$=desired spacing A=reset spacing.

A is that spacing by which the actual spacing $a_2$ is changed in order to set the desired spacing ($a_3$). If at the operating point of the machine the calculated carding nip $a_2$ varies from the desired carding nip ($a_3$), then the carding nip can be optimised by means of the PFS system (see FIGS. 6*a*, 6*b*).

In particular, the desired spacing ($a_3$) can be precisely set. A change in the carding nip also always implies a change in the temperatures. This in turn can be accompanied by a change in the carding nip. An iteration for optimisation is illustrated in FIG. 9. By using different materials (Al/GG) to compensate for thermal expansion, only very few iteration steps are needed, however.

Using the features according to the invention, a specific warming-up of the machine is also controllable. It is normal for machines to be turned off in order to change technological parameters (productions, speeds, spacings, clothing change, carding nip). If the machine is started up again from the cold state, a wrongly selected parameter can lead to clothing contact. This is attributable to a time-staggered warming-up of cylinder 4 and side panel 19. The cylinder 4 warms up markedly more quickly than the side panel 19. If now, for example, the production rate, which has the greatest influence on warming, is selected to be very high, the machine can be warmed up from the cold state with a restricted production rate. If the calculated carding nip changes are not critical after the warming-up process, the production can be increased fully automatically to the required level. A controlled warming-up of the machine is represented in FIG. 10.

The direct measurement of the actual spacing $a_2$, spacing changes Δa and the cylinder radius $r_1$ in the production phase is associated with considerable problems. In accordance with the invention the actual spacing $a_2$ (carding nip) and the spacing difference $\Delta a_2$ can be successfully determined in a simple and accurate manner indirectly at any time by way of the actual temperatures ($T_1$ and $T_2$), the actual cylinder speed n and the setting temperatures ($T_{1E}$ and $T_{2E}$). The particular advantage of this is that an optimum carding nip ($a_3$) that leads to a substantially improved product can be calculated and adjusted.

Although the foregoing invention has been described in detail by way of illustration and example for purposes of understanding, it will be obvious that changes and modifications may be practised within the scope of the appended claims.

List of reference numerals

| | |
|---|---|
| 1 = | feed roller |
| 2 = | feed table |
| 3a, b, 3c = | licker-ins |
| 4 = | cylinder |
| 4a = | cylinder clothing |
| 4b = | direction of rotation of cylinder |
| 4c, 4d = | cylinder end discs |
| 4f = | surface |
| 5 = | doffer |
| 6 = | stripping roller |
| 7, 8 = | squeezing rollers |
| 9 = | web guide element |
| 10 = | web funnel |
| 11, 12 = | take-off rollers |
| 13 = | revolving flat |
| 14 = | flat bars |
| 15 = | can |
| 16 = | can coiler |
| 17 = | flexible bend |
| 18 = | flat bar clothing |
| 19a, 19b = | side panel |
| 20 = | slideway |
| 20a = | convex outer surface |
| 20b = | concave inner surface |
| 21 = | tip circle, flat bar clothings |
| 22 = | tip circle, cylinder clothing |
| 23a, 23b = | roller journals |
| 24a, 24b = | frame walls |
| 25a, 25b = | bearings |
| 26 = | nip filler element (covering) |
| 26a = | inner space, nip filler element |
| 26b = | wall surface, nip filler element |
| 27 = | rotational speed sensor |
| 28 = | temperature probe, cylinder surface |
| 29 = | temperature probe, side panel |
| 30a, 30b, 30c = | stationary carding elements |
| 31a, 31b, 31c = | cylinder casing element (covering) |
| 32a, 32b = | extension bends |
| 33 = | driver element |
| 34 = | toothed rack |
| 35 = | gearwheel |
| 36 = | drive means |
| 37 = | adjusting screw |
| 38a, 38b = | carding clothings |
| 39 = | tip circle, carding clothings |
| 40 = | carriers |
| 41 = | cylinder covering |
| 42 = | set screw |
| 43 = | memory |
| 44 = | electronic control and regulating device |
| 45 = | output and display device |
| 46 = | actuating means |
| 47 = | electrical lead |
| 48 = | " |
| 49 = | " |
| 50 = | " |
| 51 = | " |
| 52 = | " |
| 53 = | " |
| 54 = | " |
| 55 = | " |
| 56 = | " |

What is claimed is:

1. An apparatus at a spinning preparation machine, having a clothed roller, at least one machine element located opposite the clothed roller and radially spaced therefrom, and lateral holding devices upon which at least one said machine element is supported, the apparatus comprising:

a first temperature probe to measure the temperature of the roller surface;

a rotational speed sensor to measure the speed of the roller;

a second temperature probe to measure the temperature of the holding devices;

a third temperature probe to measure the ambient temperature; and a control device to which said speed sensor and the first, second and third temperature probes are connected, wherein the control device is arranged to determine the spacing between the roller and the at least one machine element at the measured temperatures of a surface of the roller and the holding devices.

2. An apparatus according to claim 1, in which the holding devices are side panels of the machine.

3. An apparatus according to claim 1, in which said at least one machine element comprises at least one stationary clothed element.

4. An apparatus according to claim 1, in which said at least one machine element comprises at least one clothed element that is movable during operation.

5. An apparatus according to claim 1, in which the control device is capable of determining the difference between the actual spacing and a predetermined reference spacing.

6. An apparatus according to claim 1, in which the control device is capable of determining the difference between the actual spacing at the actual temperatures for the roller and the holding devices and the reference spacing at setting temperatures for the roller and the holding devices.

7. An apparatus according to claim 1, further comprising a memory device in which reference temperatures for the roller and holding devices are enterable and/or storable.

8. An apparatus according to claim 1, in which functions of the dependency of the spacing change between the actual spacing and a reference spacing on a temperature-induced change in radius of the roller, a temperature-induced change in radius of the holding devices and a speed-induced change in radius of the roller are enterable and storable in the control device.

9. An apparatus according to claim 1, in which there is stored one or more functions for one or more parameters selected from the change in spacing, the temperature-induced change of radius of the roller, the speed-induced change of radius of the roller, the temperature-induced change in dimensions of the holding devices, the change in temperature of the roller surface, and the change in temperature of the holding devices.

10. An apparatus according to claim 1, in which there are enterable in a memory with the machine switched off and/or without current one or more of: the reference spacing and the setting temperature for the roller and the holding devices; and the temperature of the roller surface, the temperature of the side panels and the speed of the roller.

11. An apparatus according to claim 1, in which the difference between the actual spacing and a reference spacing is determinable with the machine switched off and/or without current.

12. An apparatus according to claim 1, in which a separate voltage source is connected to the control device.

13. An apparatus according to claim 1, in which a device for adjusting the desired spacing is provided.

14. An apparatus according to claim 13, in which the device comprises an actuating means for changing the spacing, the actuating means being connected to a drive device that is connected to the control device.

15. An apparatus according to claim 14, in which the actuating means is capable of adjusting the desired spacing automatically, the automatic adjustment being elected in dependence on the determined spacing difference.

16. An apparatus according to claim 14, in which the machine elements are clothed working elements in the form of revolving flat bars.

17. An apparatus according to claim 1, in which the machine elements are clothed working elements in the form of stationary card flats.

18. An apparatus according to claim 1, in which the machine element is a roller.

19. An apparatus according to claim 1, in which there are present as unclothed machine elements one or more covering elements and/or one or more separating blades.

20. An apparatus according to claim 1, in which the spinning preparation machine is so arranged that the heat removal characteristics of the roller are different from those of the side panels.

21. An apparatus according to claim 1, in which the roller and the holding devices consist of different materials having different expansion coefficients.

22. An apparatus according to claim 1, in which more than one measuring element for the temperature of the roller surface is associated with the roller.

23. An apparatus according to claim 1, in which at least one said measuring element for the temperature of the roller surface is arranged on a covering element.

24. An apparatus according to claim 1, in which more than one measuring element for the temperature of the holding devices is associated with the side panels.

25. An apparatus according to claim 1, in which the holding devices are opposed lateral side panels of the machine and a measuring element for the temperature of the respective side panel is associated with each lateral side panel.

26. An apparatus according to claim 1, in which the temperature is measurable inside the interior of the cylinder and can be transmitted to the memory and/or to the control device.

27. An apparatus according to claim 1, in which, during the warm-up phase of the equipment, the production rate of the machine is less than during the operating phase.

* * * * *